US007724913B2

(12) United States Patent
Ohara

(10) Patent No.: US 7,724,913 B2
(45) Date of Patent: May 25, 2010

(54) COMPOSITE DAMPER FOR SPEAKER

(76) Inventor: Hiroshi Ohara, No.70, Lane 553, Chong-Fong Road, Lon-Tan County, Taoyuan Hsien (TW)

( * ) Notice: Subject to any disclaimer, the term of this patent is extended or adjusted under 35 U.S.C. 154(b) by 1030 days.

(21) Appl. No.: 11/368,529

(22) Filed: Mar. 7, 2006

(65) Prior Publication Data

US 2007/0223712 A1 Sep. 27, 2007

(51) Int. Cl.
*H04R 25/00* (2006.01)

(52) U.S. Cl. ..... 381/404; 381/403; 381/396

(58) Field of Classification Search ..... 381/396, 381/403, 404, 405, 398, 409, 410; 29/594, 29/609.1; 181/171, 172
See application file for complete search history.

(56) References Cited

U.S. PATENT DOCUMENTS 5,850,462 A * 12/1998 Sakamoto et al. ..... 381/405
6,700,988 B2 * 3/2004 Wu ..... 381/404
7,366,318 B2 * 4/2008 Nevill ..... 381/404
7,379,558 B2 * 5/2008 Proni ..... 381/404
2006/0251285 A1 * 11/2006 Chan ..... 381/404
2007/0154059 A1 * 7/2007 Ohara ..... 381/404

* cited by examiner

*Primary Examiner*—Huyen D Le
(74) *Attorney, Agent, or Firm*—Rabin & Berdo, P.C.

(57) ABSTRACT

A composite damper for a speaker comprises an inner ring surface material, an outer ring surface material, and a plurality of ribs connected between the inner ring surface material and the outer ring surface material. The inner ring surface material and the outer ring surface material have a plurality of alternating concentric peaks and valleys; thereby when it is coupled with a periphery of a voice coil of the speaker, it has a more stable vibration frequency.

10 Claims, 6 Drawing Sheets

COMPOSITE DAMPER FOR SPEAKER

BACKGROUND OF THE INVENTION

1. Field of the Invention

The present invention relates to a damper for a speaker, and more particularly to a composite damper having an auxiliary fixing member that is capable of stabilizing sound quality of the speaker.

2. The Prior Arts

A damper for a speaker is mounted on an outer periphery of a voice coil of the speaker. In this way, it can prevent the voice coil from generating irregular jump upon energized with electricity, thereby obtaining a stable sound quality. However, the design of conventional dampers focuses on element connection not on improvement of elasticity; thereby the conventional dampers have an unstable sound quality. When the voice coil is vibrating, it vibrates not only in up and down directions but also in lateral direction. Accordingly, how to make the voice coil stable vibration has become an important issue that needs to be overcome.

An example of improved dampers having an auxiliary fixing member is illustrated in FIG. 6 of the attached drawings. Top and bottom surfaces of the damper each mounts with a fixing member (A), which comprises a first fixing ring (A1), a second fixing ring (A2), and a plurality of ribs (A3) connected between the first fixing ring (A1) and the second fixing ring (A2). The ribs (A3) has a corrugated surface coincided with a plurality of alternating concentric peaks and valleys on the damper, so that the fixing members (A) can be tightly mounted on the damper due to the structure. However, the damper and the fixing member (A) need to be separately molded and then are coupled with each other. It needs not only an additional production step with extra cost but also increases hardness of the damper due to the three-layer structure. Accordingly it has a relatively bad elasticity.

Since the conventional damper is made by single-piece material, once the speaker generates irregular jumps, it will result in a bad sound quality. Thus, it is desired to provide with a composite damper for a speaker, which is capable of solving the-defects of the conventional dampers, simplifying production process as well as reducing production cost.

SUMMARY OF THE INVENTION

A composite damper for a speaker in accordance with the present invention comprises an inner ring surface material, an outer ring surface material, and a plurality of ribs connected between the inner ring surface material and the outer ring surface material, wherein the inner ring surface material and the outer ring surface material has a plurality of alternating concentric peaks and valleys.

In accordance with a first aspect of the present invention, the inner ring surface material, the ribs and an outer ring bracket are integrally molded using a plastic or rubber injection mold process, and the outer ring bracket is coupled by adhesive with the outer ring surface material, wherein the outer ring surface material is made of knitted mesh fabric and thermal-pressed to form a plurality of alternating concentric peaks and valleys.

In accordance with a second aspect of the present invention, the outer ring surface material, the ribs and an inner ring bracket are integrally molded using the plastic or rubber injection mold process, and the inner ring bracket is coupled by adhesive with the inner ring surface material, wherein the inner ring surface material is made of knitted mesh fabric and thermal-pressed to form a plurality of alternating concentric peaks and valleys.

In accordance with a third aspect of the present invention, an inner ring bracket, the ribs and an outer ring bracket are integrally molded using the plastic or rubber injection mold process; and the inner and outer ring brackets are respectively coupled by adhesive with the inner and outer ring surface materials, wherein the inner and outer ring surface materials are made of knitted mesh fabric and thermal-pressed to form a plurality of alternating concentric peaks and valleys.

In accordance with a fourth aspect of the present invention, the inner ring surface material, the ribs, and the outer ring surface material are integrally molded using the plastic or rubber injection mold process, and the inner and outer ring surface materials have a plurality of alternating concentric peaks and valleys.

In accordance with a fifth aspect of the present invention, the inner and outer ring surface materials are made of knitted mesh fabric and thermal-pressed to form a plurality of alternating concentric peaks and valleys, then are put in a mold cavity with a corresponding shape, and finally, an inner ring bracket, an outer ring bracket, and the ribs connected between the inner ring bracket and the outer ring bracket are molded by an injection overmold process, wherein the inner ring bracket is coupled with an outer rim of the inner ring surface material and the outer ring bracket is coupled with an inner rim of the outer ring surface material.

Compared with prior dampers made of a single-layer fabric, the composite damper in accordance with the present invention has a better elasticity. When it is coupled with a voice coil of a speaker, it is not liable to be destroyed after a long time use. In addition, the damper of the present invention has a simple manufacturing process, stable vibration frequency, and excellent sound quality.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
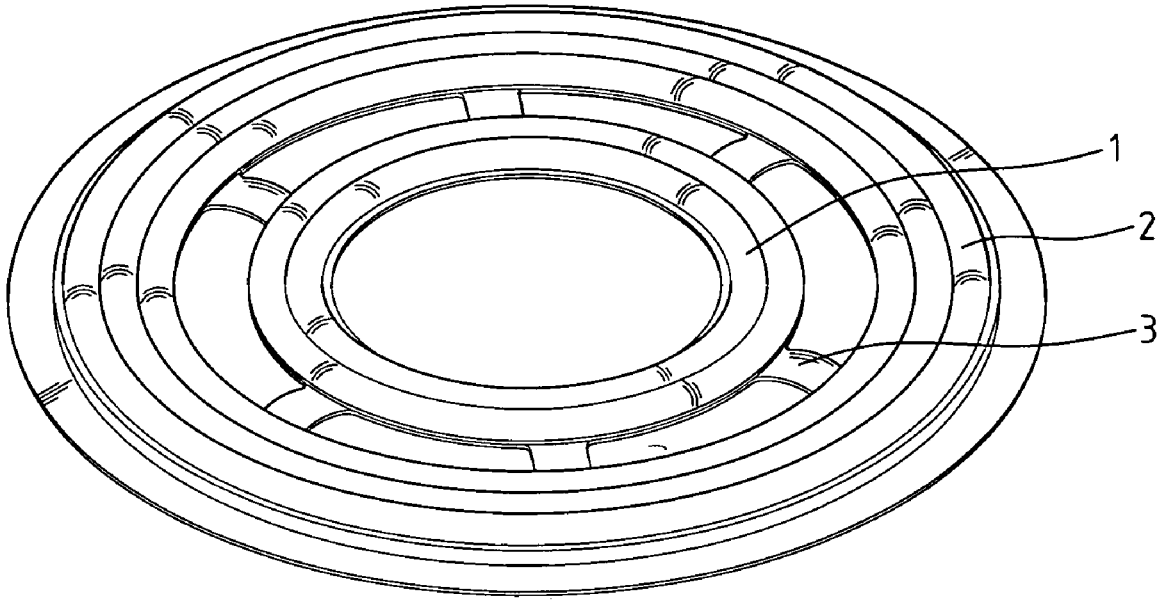
FIG. 1 is a perspective view of a composite damper for a speaker in accordance with the present invention.
Figure 5:
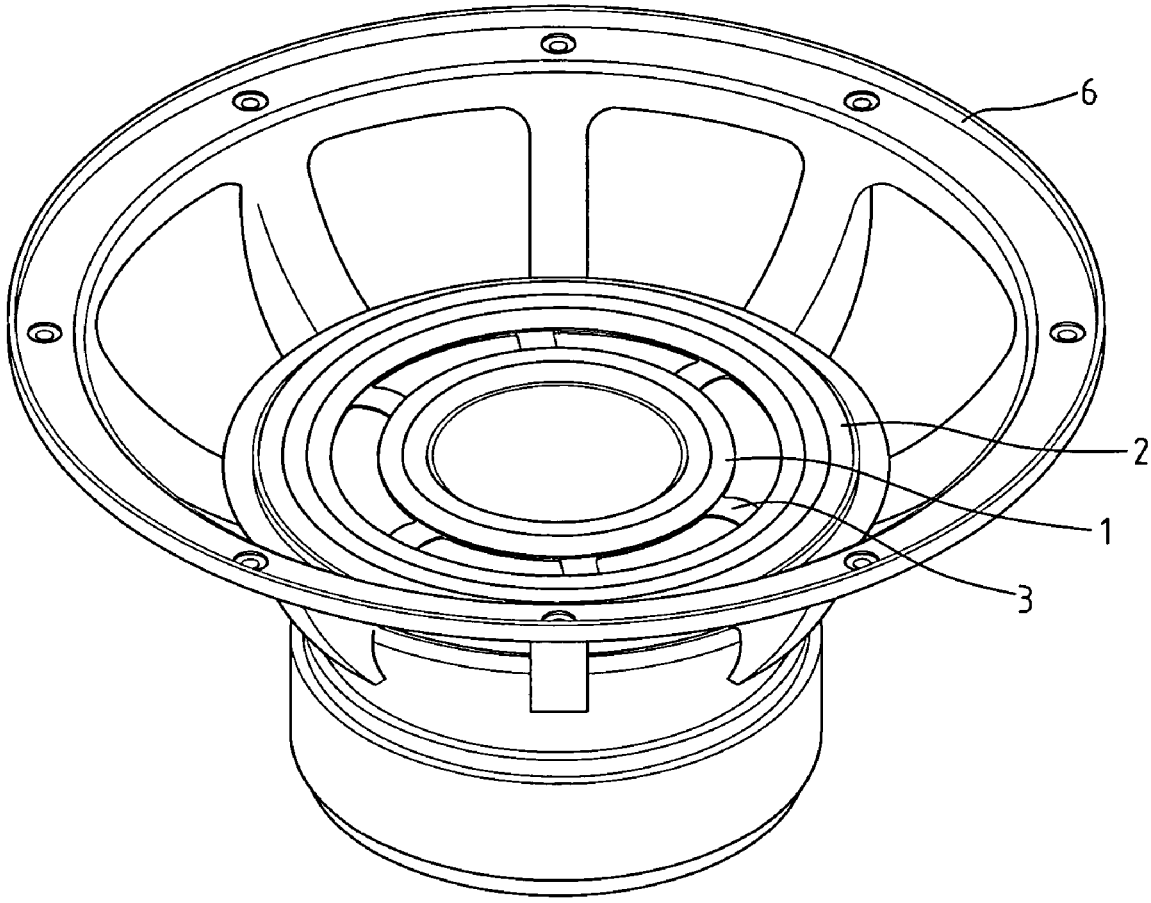
FIG. 5 is a schematic view of the composite damper of the present invention mounted on a voice coil of the speaker.
Figure 6:
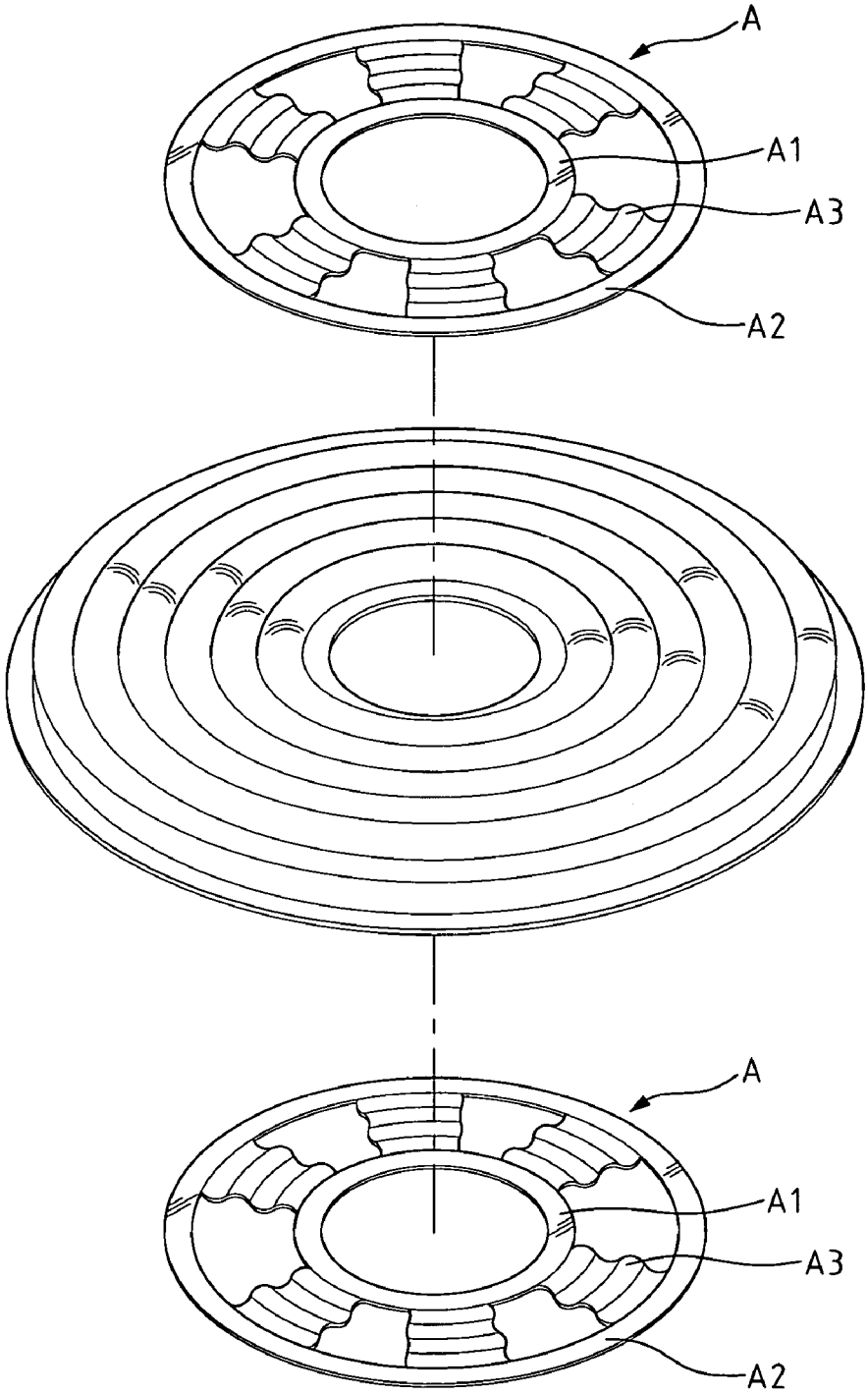
FIG. 6 (PRIOR ART)
FIG. 6 is an exploded view of a conventional damper with auxiliary fixing members.

With reference to FIG. 1, a composite damper for a speaker in accordance with the present invention comprises an inner ring surface material 1, an outer ring surface material 2 and a plurality of ribs 3 connected between the two surface materials 1, 2. The ribs 3 are elastomer. The damper forms a plurality of alternating concentric peaks and valleys on surfaces of the two surface materials 1, 2, so that when it is coupled with a periphery of a voice coil 6 of the speaker (see FIG. 5), it has a more stable vibration frequency due to the structure of the peaks and valleys.

Figure 2:
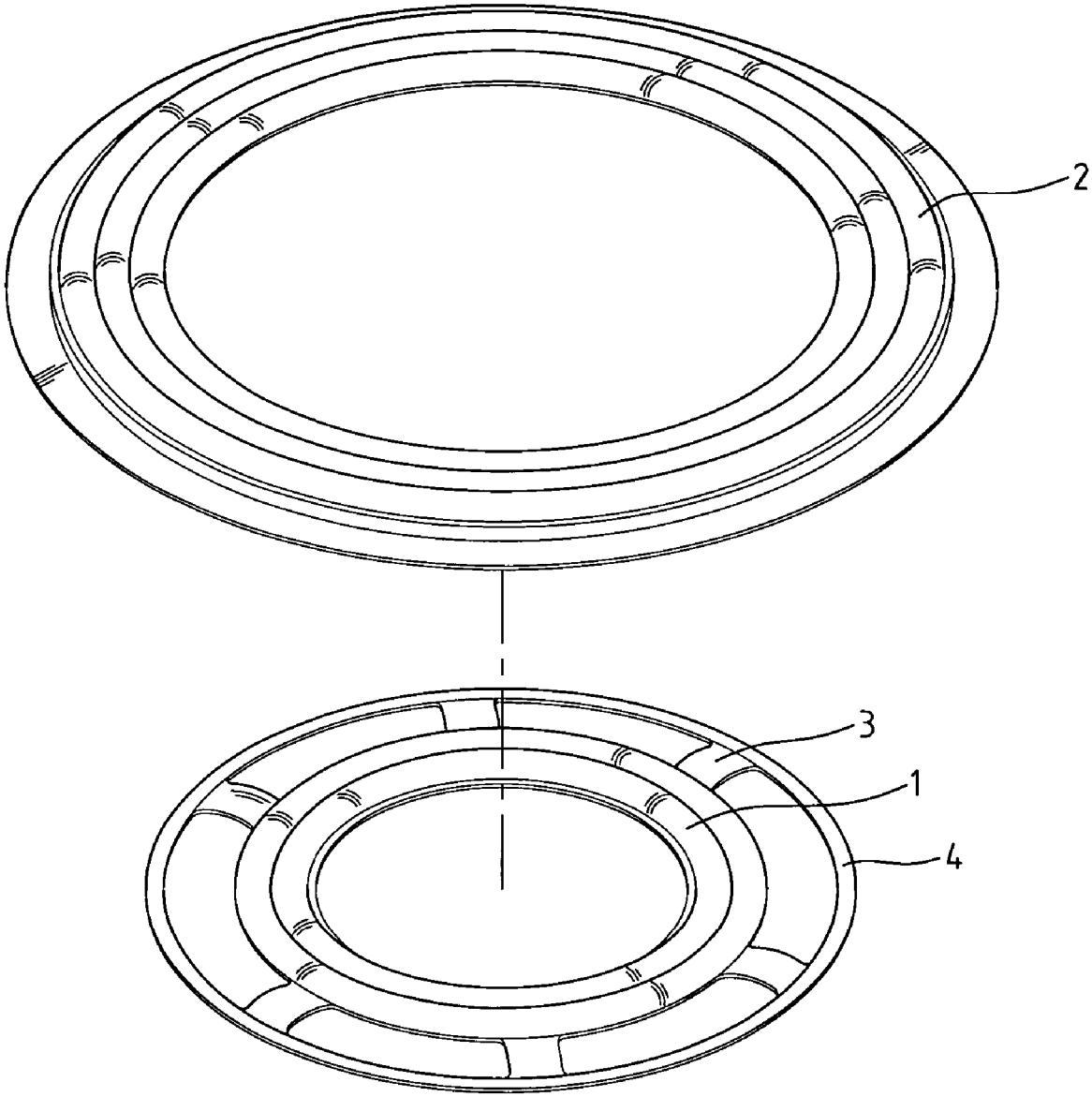
FIG. 2 is an exploded view of a composite damper for a speaker in accordance with a first preferred embodiment of the present invention

Referring to FIG. 2, which illustrates a first preferred embodiment of the present invention, the inner ring surface material 1, an outer ring bracket 4 and the ribs 3 connected between the inner ring surface material 1 and the outer ring bracket 4 are integrally molded using a plastic or rubber injection mold process. Then the outer ring bracket 4 is coupled by adhesive with the outer ring surface material 2, which is made of knitted mesh fabric and thermal-pressed to form a plurality of alternating concentric peaks and valleys.

Figure 3:
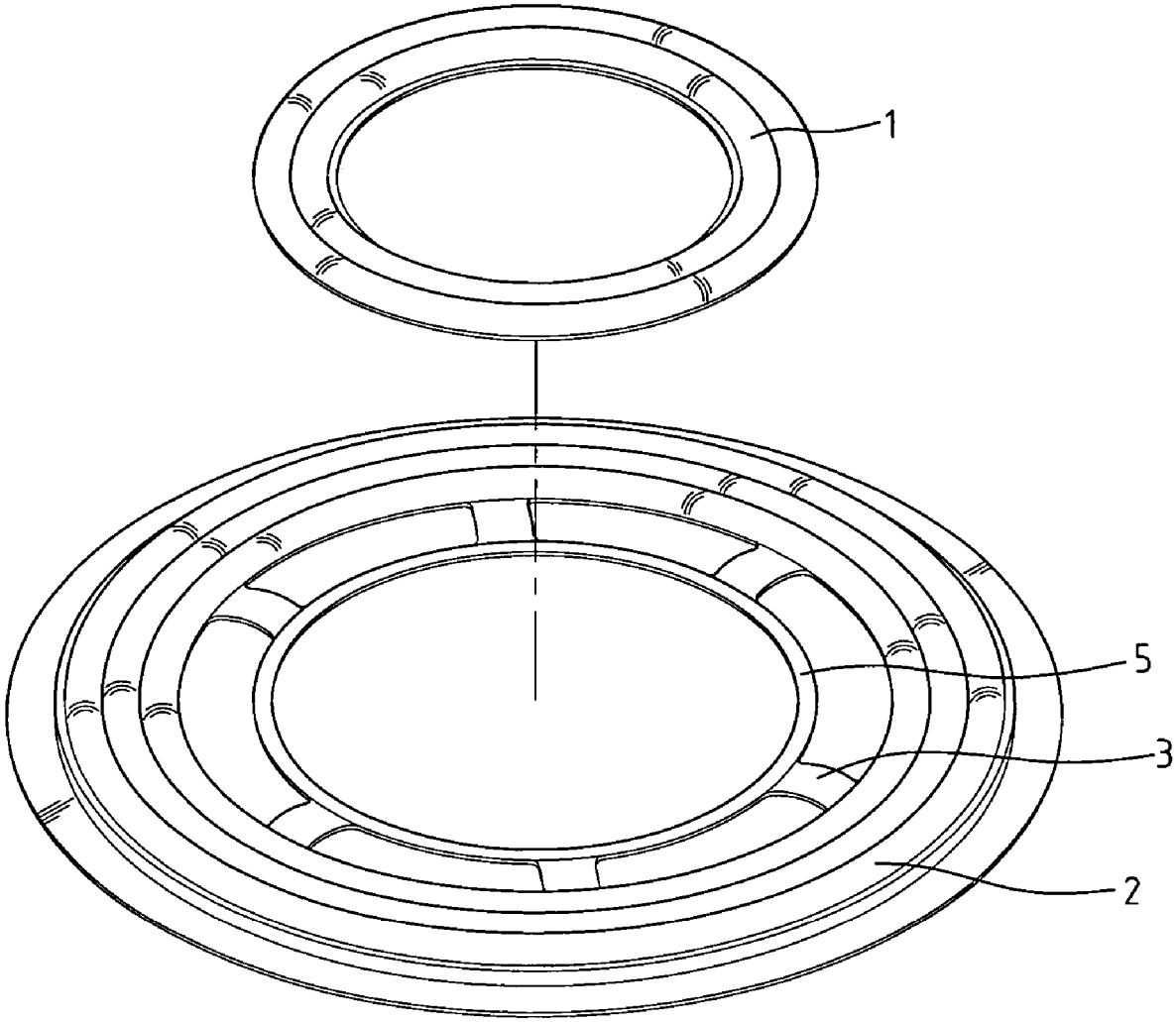
FIG. 3 is an exploded view of a composite damper for a speaker in accordance with a second preferred embodiment of the present invention

Referring to FIG. 3, which illustrates a second preferred embodiment of the present invention, the outer ring surface material 2, an inner ring bracket 5 and the ribs 3 connected between the outer ring surface material 2 and the inner ring bracket 5 are integrally molded using the plastic or rubber injection mold process. Then the inner ring bracket 5 is coupled by adhesive with the inner ring surface material 1, which is made of knitted mesh fabric and thermal-pressed to form a plurality of alternating concentric peaks and valleys.

Figure 4:
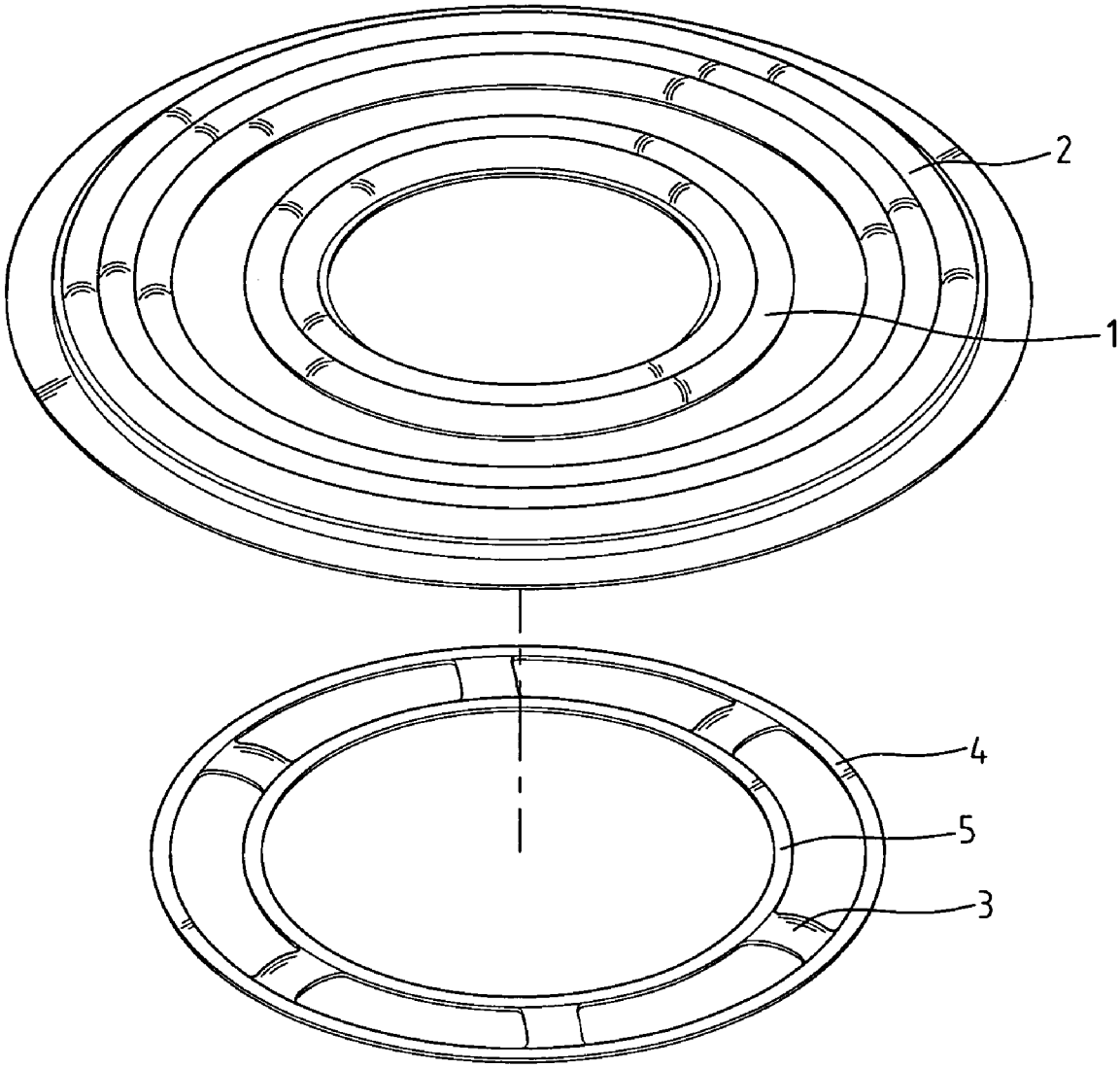
FIG. 4 is an exploded view of a composite damper for a speaker in accordance with a third preferred embodiment of the present invention

Referring to FIG. 4, which illustrates a third preferred embodiment of the present invention, an inner ring bracket 5, an outer ring bracket 4 and the ribs 3 connected between the inner ring bracket 5 and the outer ring bracket 4 are integrally molded using the plastic or rubber injection mold process. Then the two brackets 5, 4 are coupled by adhesive with the inner ring surface material 1 and the outer ring surface material 2, respectively, which are made of knitted mesh fabric and thermal-pressed to form a plurality of alternating concentric peaks and valleys.

According to a fourth preferred embodiment of the present invention, the inner ring surface material 1, the outer ring surface material 2, and the ribs 3 connected with the inner ring surface material 1 and the outer ring surface material 2 are integrally molded using the plastic or rubber injection mold process, wherein the two surface materials 1, 2 have a plurality of alternating concentric peaks and valleys, as shown in FIG. 1.

According to a fifth preferred embodiment of the present invention, the inner ring surface material 1 and the outer ring surface material 2 are made of knitted mesh fabric and thermal-pressed to form a plurality of alternating concentric peaks and valleys, then are put in a mold cavity with a corresponding shape, and finally, an inner ring bracket 5, an outer ring bracket 4, and the ribs 3 connected between the inner ring bracket 5 and the outer ring bracket 4 are molded by an injection overmold process, wherein the inner ring bracket 5 is coupled with an outer rim of the inner ring surface material 1 and the outer ring bracket 4 is coupled with an inner rim of the outer ring surface material 2.

The ribs 3 can be shaped curve plane or flat plane for connection of the inner ring surface material 1 and the outer ring surface material 2.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A composite damper for a speaker, comprising:

an inner ring surface material having a plurality of alternating concentric peaks and valleys;

an outer ring surface material having a plurality of alternating concentric peaks and valleys; and a plurality of ribs being elastomer and connected between the inner ring surface material and the outer ring surface material, wherein the inner ring surface material and the outer ring surface material are spaced apart from one another in a radial direction thereof and are connected to each other by the plurality of ribs and so as to form the composite damper.

2. The composite damper as claimed in claim 1, wherein one end of each of the ribs is connected with the inner ring surface material and the other end of each of the ribs is connected with an outer ring bracket connected with the outer ring surface material.

3. The composite damper as claimed in claim 2, wherein the inner ring surface material, the ribs and the outer ring bracket are integrally molded using a plastic injection molding process, and the outer ring surface material is knitted mesh fabric.

4. The composite damper as claimed in claim 1, wherein one end of each of the ribs is connected with the outer ring surface material and the other end of each of the ribs is connected with an inner ring bracket connected with the inner ring surface material.

5. The composite damper as claimed in claim 4, wherein the outer ring surface material, the ribs and the inner ring bracket are integrally molded using a plastic injection molding process, and the inner ring surface material is knitted mesh fabric.

6. The composite damper as claimed in claim 1, further comprising:

an inner ring bracket; and an outer ring bracket connected by an adhesive to the inner ring surface material and the outer ring surface material, wherein each of the ribs have two ends, and each end of each of the ribs is respectively connected to an inner ring bracket and an outer ring bracket.

7. The composite damper as claimed in claim 1, wherein the inner ring surface material, the ribs and the outer ring surface material are integrally molded using a plastic injection molding process.

8. The composite damper as claimed in claim 1, wherein the ribs are shaped along a curved plane.

9. The composite damper as claimed in claim 1, wherein the ribs are shaped along a flat plane.

10. A composite damper for a speaker, comprising:

an inner ring having a plurality of alternating concentric peaks and valleys;

an outer ring encircling the inner ring and having a plurality of alternating concentric peaks and valleys, and disposed coaxially with and separated from the inner ring at an inner circumference thereof; and a plurality of elastomer ribs having a first end and a second end opposite to the first end, each of the ribs respectively connecting at the first end to an outer circumference of the inner ring and at the second end to an inner circumference of the outer ring.

* * * * *